United States Patent [19]

Foley

[11] 4,399,784

[45] Aug. 23, 1983

[54] INTERNAL COMBUSTION ENGINE

[76] Inventor: James E. Foley, WW Ranch, St. R.D. 512, Sebastian, Fla. 32958

[21] Appl. No.: 255,173

[22] Filed: Apr. 17, 1981

Related U.S. Application Data

[63] Continuation-in-part of Ser. No. 233,298, Feb. 10, 1981.

[51] Int. Cl.[3] ..... F02D 13/06

[52] U.S. Cl. ..... 123/198 F; 123/90.18; 123/90.32

[58] Field of Search ..... 123/90.18, 90.32, 90.15, 123/198 F

[56] References Cited

U.S. PATENT DOCUMENTS 2,528,983 11/1950 Weiss ..... 123/90.18

3,638,624 2/1972 O'Grady ..... 123/90.18

3,986,484 10/1976 Dyer ..... 123/90.16

*Primary Examiner*—Ira S. Lazarus

*Attorney, Agent, or Firm*—Steele, Gould & Fried

[57] ABSTRACT

An internal combustion engine having at least one cylinder, the at least one cylinder having intake and exhaust ports, the engine comprising: a slidably and rotatably disposed camshaft; a cam and follower arrangement including cam lobes disposed on the camshaft, for controlling the intake and exhaust ports, each of the cam lobes having multiple lift surfaces which are shaped to provide at least two different periods of time during which the intake and exhaust ports are open; and, apparatus for axially displacing the camshaft during operation of the engine, whereby the different periods of time may be selected in accordance with engine or vehicle speed.

9 Claims, 13 Drawing Figures

FIG. 3
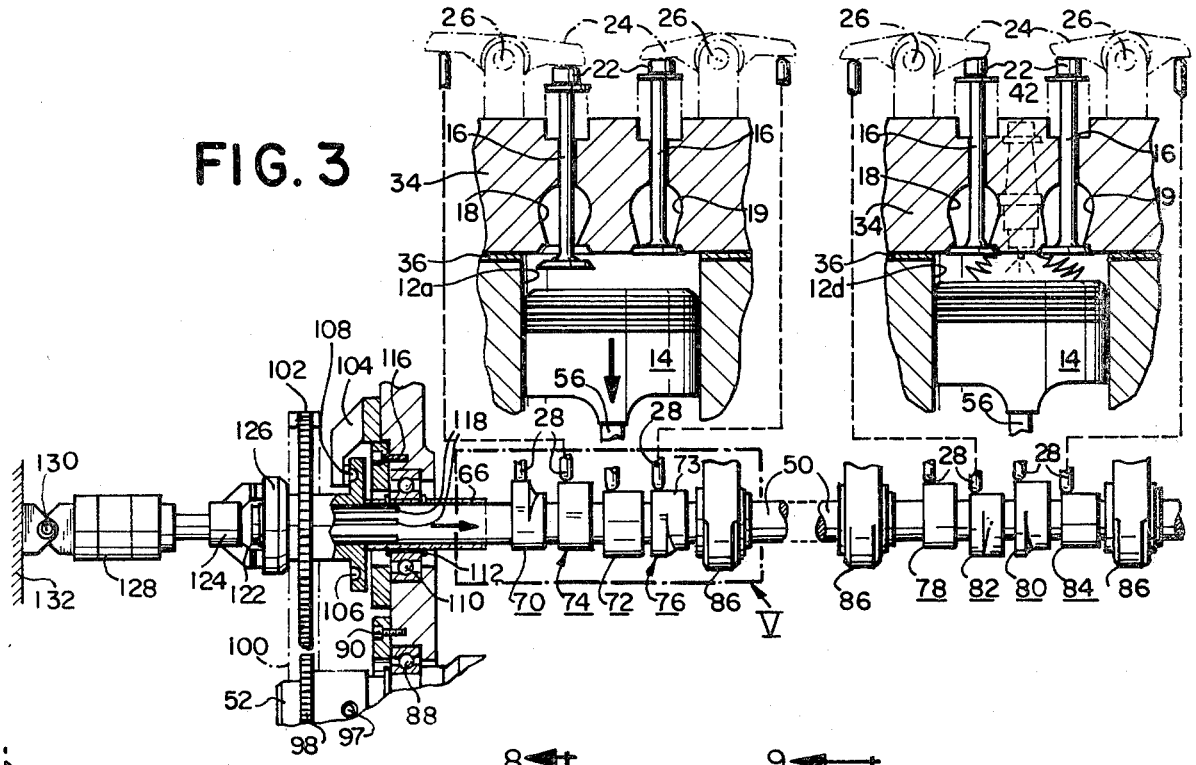
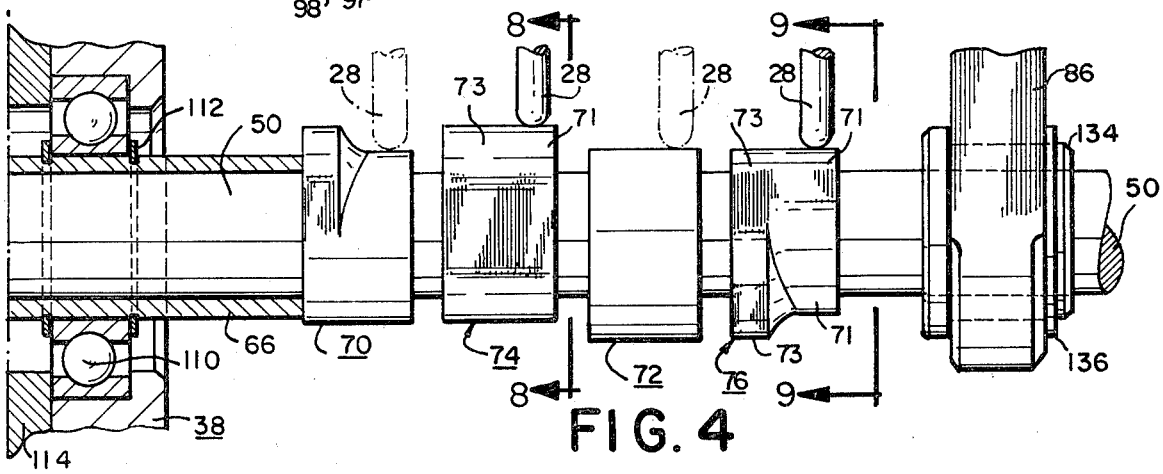
FIG. 4
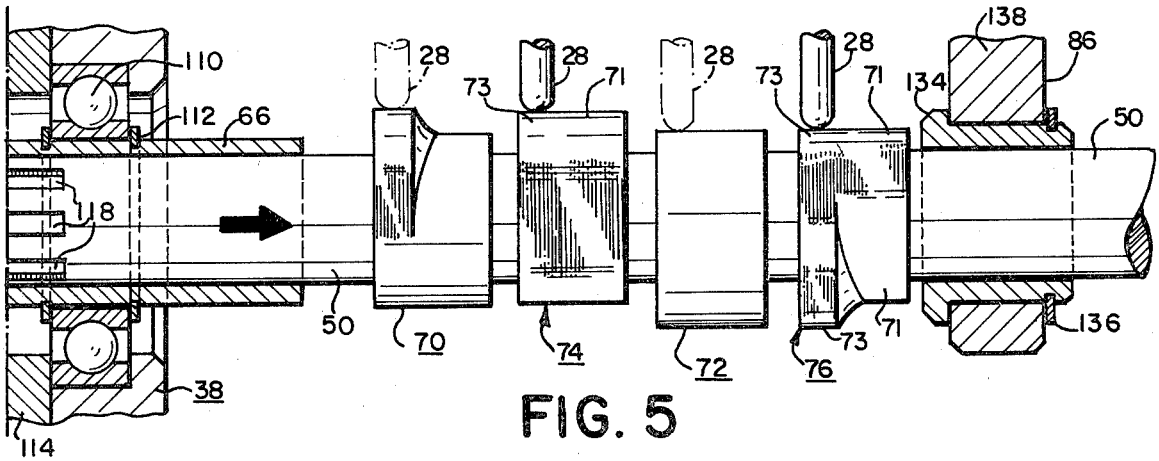
FIG. 5

INTERNAL COMBUSTION ENGINE

CROSS-REFERENCES

This is a continuation-in-part of my copending Patent Application Ser. No. 233,298, filed Feb. 10, 1981.

BACKGROUND OF THE INVENTION

1. Field of the Invention

This invention relates to the field of internal combustion engines in general, and in particular to such engines having adjustably timed valves or ports, the control of which will conserve fuel.

2. Prior Art

The internal combustion engine art has for many years been attempting to solve the problem of fuel being wasted during low speed conditions due to the non-adjustment capabilities of the engine upon completion of high speed requirements. Until recently, only a partial solution has been provided by automatic spark advance in the distributor. Consequently, numerous approaches have been devised to provide an adjustment mechanism so that the engine will use less fuel during these conditions. Typically, this has been accomplished by disabling selected cylinders, which ordinarily involves the interruption of the fuel flow. Some have gone as far as teaching the removal of several portions of the cylinder such that even during heavy load operation these cylinders are still ineffective, for example U.S. Pat. Nos. 3,874,358-Crower, 3,945,367-Turner and 4,070,971-Studebaker. In each of these patent the intake and exhaust valves of the disabled cylinders are purposely maintained in a continuously closed orientation, providing an amount of vacuum and compression during the operation of the engine. To overcome this problem U.S. Pat. No. 3,874,358 teaches the substitution of pistons having passages therein to prevent these effects. U.S. Pat. No. 3,945,367 teaches connecting hoses to the opening from which the spark plug is removed to act as an air intake and exhaust. U.S. Pat. No. 4,070,971 teaches the removal of the pistons altogether.

In an effort to render certain cylinders nonfunctional and yet keep them available for use during heavy load conditions, various push rod, rocker arm and valve devices have been described which may selectively or periodically disable particular cylinders. As noted in U.S. Pat. No. 4,151,817-Mueller the prior art is replete with patents teaching valve disablement.

A few patents have included cam lobe modification in their attempt to solve the fuel waste problem. U.S. Pat. Nos. 2,934,052-Longenecker and 3,277,874-Wagner disclose camshafts with high and low lift lobes for actuating each of the engine valves and means for causing the high or low lift lobe to so activate the valve. In U.S. Pat. No. 2,934,052 an actuating rod is utilized to shift the cam-follower members from one lift lobe to another. The camshaft is taught to be supported by suitable journals mounted in bearings in the engine frame, i.e., the camshaft is axially stationary. U.S. Pat. No. 3,277,874 discloses long and short lift lobe surfaces mounted on an axially stationary camshaft, in conjunction with a fluid operated cam-follower which is positioned at one end of a push rod. The use of modified cam lobes, disposed on an axially displaceable camshaft, to selectively disable cylinders is the subject of my co-pending Patent Application Ser. No. 233,298, filed Feb. 10, 1981.

Fuel efficiency can be optimized, or maximized, by valve timing which reflects the needs and operating conditions of an engine and that which the engine principally "drives", the transmission. A typical four cycle internal combustion engine experiences four unique operating conditions. The first cycle is the intake stroke. As the intake stroke begins, the piston moves from its outermost position inwardly toward the crankshaft. The intake valve opens, and a combustible air-fuel mixture is drawn or sucked into the cylinder. In the compression stroke, the intake port closes and the piston moves outwardly again compressing the air-fuel mixture. At the top of the compression stroke, the spark plug fires and the air-fuel mixture is ignited. Ignition need not take place precisely at the top dead center (TDC) of the stroke, and is typically some degrees before or after TDC, the term degrees referring to rotation of the crankshaft. As the mixture explodes, the piston is driven inwardly, forming the power stroke. Finally, the piston moves outwardly again, as the exhaust port is opened. In the exhaust stroke, the spent products of combustion are ejected from the cylinder. The four cycles are then repeated. In two cycle engines, cycles are combined as is known in the art. Although the principles of this invention will be illustrated in connection with a four cycle engine, they are also applicable to two cycle engines, rotary engines and radial engines. During low speed engine conditions relatively lengthy compression and power strokes will maximize efficiency. During high speed engine conditions relatively lengthy intake and exhaust strokes will maximize efficiency. In a preferred embodiment this invention meets these requirements by providing cam lobes having multiple lift surfaces, the cam lobes being disposed on an axially displaceable cam shaft. During low speed operation a relatively brief amount of lift is transferred through the cam followers for a relatively shorter timed interval to the exhaust and intake valves, and during high speed operation a relatively long amount of lift is provided for a relatively longer timed interval.

Heretofore there has been no suggestion of an internal combustion engine wherein cylinders have cam-activated exhaust and intake ports and cam lobes with multiple lift surfaces shaped to provide selective maintenance of the exhaust and intake ports in an open condition for a plurality of different time periods, wherein the cam lobes are disposed on camshafts capable of axial or longitudinal movement so that the various lift surfaces of the shaped lobes can come to bear in controlling the valves or ports.

SUMMARY OF THE INVENTION

It is an object of this invention to provide an internal combustion engine which optimizes fuel economy at both low and high speed operating conditions.

It is another object of this invention to provide an internal combustion engine which optimizes fuel economy during idling conditions.

It is yet another object of this invention to provide an internal combustion engine having at least one cylinder with exhaust and intake ports which are selectively controlled to open for different periods of time in accordance with engine operating conditions, including load factors.

These and other objects are accomplished in accordance with the principles of this invention by an internal combustion engine having at least one cylinder, said at least one cylinder having intake and exhaust ports, said engine comprising: a slidably and rotatably disposed camshaft; cam means, including cam lobes disposed on said camshaft, for controlling said intake and exhaust ports, each of said cam lobes having multiple lift surfaces which are shaped to provide at least two different periods of time during which said intake and exhaust ports are open; and, means for axially displacing said camshaft during operation of said engine, whereby said lift surfaces are selectively engaged to provide said different periods of time in accordance with engine speed or other operating parameters. The multiple lift surfaces of the cam lobes each comprise at least first and second surfaces, each of the surfaces being brought into contact with a follower member by an axial displacement of the camshaft. The axial or longitudinal movement is preferably effected by an hydraulic cylinder which is activated in response to particular engine conditions, such as engine speed, manifold pressure and transmission response. In the presently preferred embodiment, all cylinders of the engine are provided with adjustably controllable ports.

BRIEF DESCRIPTION OF THE DRAWINGS

For the purposes of illustrating the invention, there are shown in the drawings forms which are presently preferred; it being understood, however, that this invention is not limited to the precise arrangements and instrumentalities shown.

FIG. 3 is a view identical to FIG. 2 except that portions of the crankshaft have been removed and the camshaft has been axially displaced;

FIG. 4 is an enlarged view of a portion of the present invention defined by the box designated IV in FIG. 2;

FIG. 5 is a view identical to FIG. 4 except that the camshaft positioning bracket has been partially cut away and the camshaft has been axially displaced back to the position of FIG. 2;

DETAILED DESCRIPTION OF THE PREFERRED EMBODIMENTS

Figure 1:
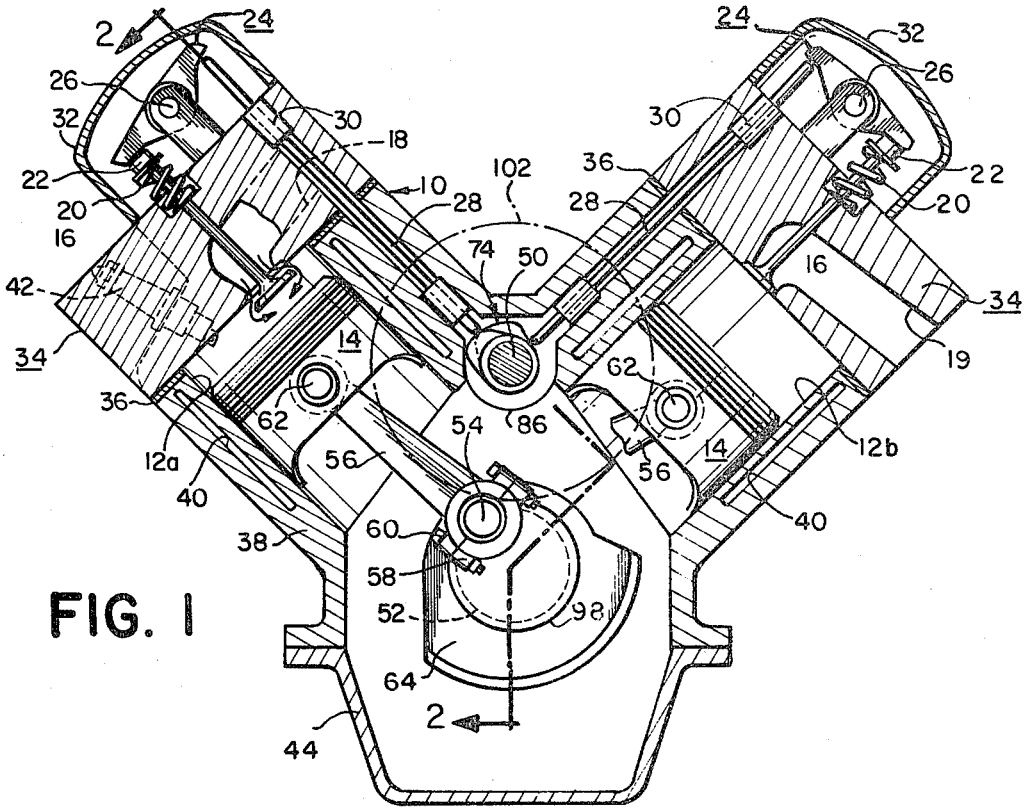
FIG. 1 is a cross-sectional view of an internal combustion engine according to this invention.

An internal combustion engine incorporating adjustably timed intake and exhaust ports according to this invention is shown in FIG. 1 and generally designated 10.

The internal combustion engine 10 comprises an engine block 38, oil pan 44, manifolds 34 and crankshaft 52. The engine 10 may be a V-type engine as illustrated, having a plurality of cylinders disposed in two rows along the length of block 38. Cylinder 12*a* has cam-activated means, including cam lobes disposed on a camshaft, for controlling the intake and exhaust ports, each of the cam lobes having multiple lift surfaces shaped to provide at least two different periods of time (timed intervals) during which the exhaust and intake ports are open. Cylinder 12*b* has cam-activated exhaust and intake ports and cam lobes which function similar to those associated with cylinder 12*a*.

In FIG. 1, cylinder 12*a* is operating in the intake stroke, with a fuel-air mixture being drawn into the cylinders through intake port 18, as shown by the curved arrows. The suction effect is being caused by piston 14 moving towards crankshaft 52 as the crankshaft rotates in a clockwise direction. Piston 14 is connected to crankshaft 52 by piston rod 56. Piston rod 56 is rotatably connected to piston 14 by pin 62. Piston rod 56 is rotatably connected to piston rod pivot pin 54 of crankshaft 52 by securing piston rod under-carriage 58 to the bottom of piston rod 56 by connection means, such as bolts 60. Piston rod pivot pin 54 is eccentrically disposed with respect to the axis of rotation of crankshaft 52. A standard counterweight 64, associated with cylinder 12*a* and piston 14 is also disposed on the crankshaft. As crankshaft 52 rotates in a clockwise direction, piston 14 moves into and out of cylinder 12*a*, the counterweight 64 providing balancing inertial forces.

Coolant passages 40 are disposed within the edges of block 38 for the purpose of taking heat away from the cylinders to ensure a more efficient operation by preventing the degradation of lubricants contained therein or the untimely ignition of the fuel-air mixture. To maintain the cylinders in a relatively air tight relationship, gaskets 36 are interposed between manifolds 34 and engine block 38. The intake and exhaust parts, 18 and 19 respectively should be the only fluid conductive openings in the cylinders.

Figure 2:
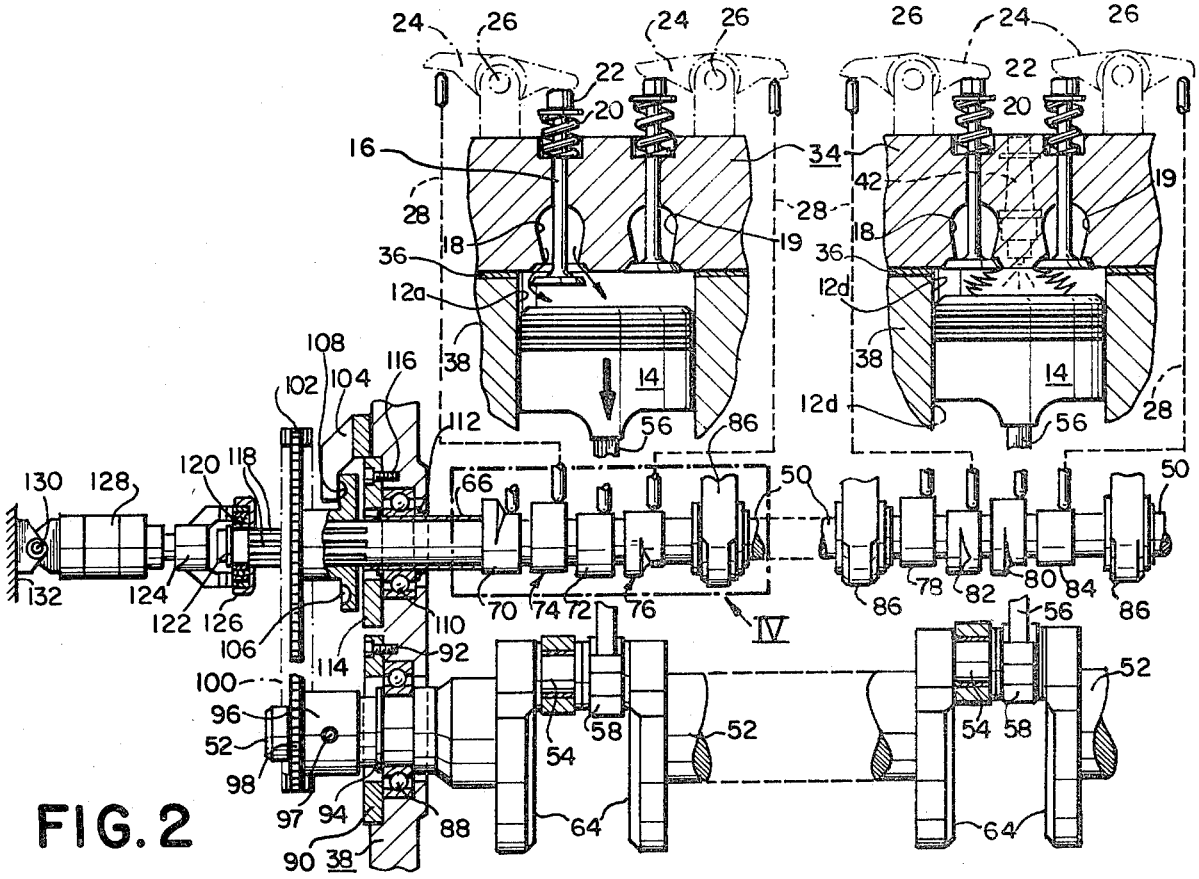
FIG. 2 is a section view along the line 2—2 of FIG. 1, wherein the rocker arms have been rotated 90° and the push rods and the piston rods are partially schematically shown.

Camshaft 50 is slidably and rotatably disposed in block 38 and is held in position by camshaft positioning brackets 86. In the illustrated embodiment, the axially displacable camshaft is positioned at the bottom of a V-shaped well defined by cylinders. With further reference to FIG. 2, cam lobes 70, 72, 74, 76, 78, 80, 82 and 84, are disposed on the camshaft. Cam lobes 70, 74, 78 and 82 operate intake ports and cam lobes 72, 76, 80 and 84 operate exhaust ports. The cam lobes have multiple lift surfaces which are shaped to provide selective maintenance of the exhaust and intake ports in an open condition for a plurality of different time periods, or timed intervals. Push rods 28 are slidably disposed within push rod chamber 30 and are biased to engage and follow the cam lobe surfaces. The push rod 28 associated with cylinder 12*b* is not following cam lobe 74 as might appear from FIG. 1, but is actually disposed after or behind that lobe, and is in fact following cam lobe 72. The ends of push rods 28 opposite the camshaft are biased against and engage rocker arms 24. Rocker arms 24 are pivotally connected to an extension of manifold 34 by rocker pivot pins 26. The ends of rocker arms 24 which are opposite the push rods 28 are biased against and engage spring retaining caps 22 which are securely attached to poppet valves 16. Biasing springs 20 are securely contained between spring retaining caps 22 and manifold 34. It is biasing springs 20 which act to keep the intake and exhaust ports in normally closed positions and also act to maintain push rods 28 in a surface following and engaging relationship with the cam lobes, the cam lobes being securely attached to camshaft 50. With reference to cylinder 12*a*, as camshaft 50 rotates, the lift surfaces of the cam lobes force the push rod 28 away from camshaft 50. This motion is translated through rocker arm 24, causing a movement of poppet valve 16, which opens the intake port to cylinder 12*a*. Spark plugs 42 are also shown in FIG. 1 and are provided to ignite the fuel-air mixture contained in the cylinders after a compression stroke has occurred. As shown in FIG. 2, cylinder 12*d* has completed a compression stroke and spark plug 42 is igniting the fuel-air mixture contained therein.

With reference to block IV of FIG. 2 and FIG. 4, an exhaust cam lobe 76 is secured to camshaft 50. Cam lobe 76 comprises multiple lift surfaces 71 and 73. Lift surface 71 maintains the exhaust port of cylinder 12*a* in an open condition for a relatively short or brief timed interval and lift surface 73 maintains the exhaust port of cylinder 12*a* in an open condition for a relatively long timed interval. Intake cam lobe 74 also comprises multiple lift surfaces 71 and 73. Lift surface 71 maintains intake port 18 in an open condition for a relatively brief timed interval. Lift surface 73 maintains exhaust port 18 in an open condition for a relatively long timed interval. Referring to FIG. 4, camshaft 50 is disposed in a first axial or longitudinal position with respect to the block, manifolds, push rods and other structure. Push rods 28 are following the lift surfaces 71 of the intake and exhaust cam lobes (on the righthand sides of the cam lobes in the sense of FIG. 4), which maintain the intake and exhaust ports in an open condition for relatively brief periods of time. In FIG. 5, camshaft 50 has been axially or longitudinally shifted to a second position (to the right) such that push rods 28 are now following the lift surfaces 73 of cam lobes 74 and 76 (on the left hand sides of the cam lobes). The intake and exhaust ports of cylinder 12*a* are now maintained in an open condition for relatively long time periods. The means for axially displacing the camshaft 50 are explained in more detail hereinafter.

As illustrated in FIGS. 2, 3, 4 and 5, the cam lobes disposed between each camshaft positioning bracket 86 operate the ports of two cylinders, each disposed on opposite sides of block 38, and are arranged in the normal fashion as intake, intake, exhaust and exhaust lobes (from left to right in the sense of the Figures). The precise arrangement of the lobes to one another with respect to operation of an intake or exhaust port is not critical to this invention and lobes according to this invention could have alternative arrangements such as intake, exhaust, intake, exhaust. In some internal combustion engines, particularly high compression engines, the method or manner of maintaining the exhaust and intake ports in an open condition will be timed in response to the rising action of piston in the cylinder. It is preferred that the piston head not strike the exhaust poppet valve. This can be accomplished by either making an appropriate indentation in the cam lobe surface to allow a brief movement of the poppet valve to avoid the cylinder head, or, the distance the poppet valve extends into the cylinder can be made sufficiently small so that the cylinder head does not strike the poppet valve.

As shown in FIG. 2, crankshaft 52 is rotatably disposed within block 38 by crankshaft bearings 88. Bearings 88 are secured to crankshaft 52 by means of crankshaft bearing positioning C-rings 94. Bearings 88 are securely attached to block 38 by means of crankshaft bearing securement rings 90 which are securely attached to block 38 by attachment means such as bolts 92. Crankshaft gear 98 is securely attached to the crankshaft 52 by attachment means such as bolt 97. Bolt 97 passes through the body 96 of crankshaft gear 98 into the crankshaft. The rotational movement of the crankshaft is transmitted to the camshaft by means of camshaft gear actuation chain 100 which connects the crankshaft gear 98 to the circumference of camshaft gear 102 is two times greater than the circumference of crankshaft gear 98. Thus, the crankshaft will rotate twice to a single rotation of the camshaft. Camshaft gear 102 is held in place by means of camshaft gear retaining fingers 104. It is preferred that three retaining fingers 104 be equally spaced around the circumference of the camshaft gear at 120° intervals. Only one of these fingers is shown in FIG. 2 and all are securely attached to block 38.

Camshaft 50 is slidably and rotatably disposed within block 38 by means of camshaft positioning brackets 86. Camshaft 50 extends through block 38 and is slidably and rotatably disposed within camshaft rotation tube 66. Camshaft rotation tube 66 is securely attached to camshaft bearing 110 by means of camshaft bearing positioning C-rings 112. Bearing 110 is securely attached to block 38 by means of camshaft bearing securement ring 114. Securement ring 114 is securely attached to block 38 by bolt 116. The rotational movement of gear 102 is transmitted to the camshaft by means of splined ridges 118 contained on the camshaft surface and which pass through corresponding grooves in gear 102.

As can be seen in FIG. 5, camshaft positioning brackets 86 include sleeve bearings 134 which in turn are securely attached to bracket 138 by means of sleeve bearing securement ring 136. Thus, it can be seen that the camshaft 50 is capable of axial or longitudinal movement during rotation.

The means for axially shifting the camshaft is shown in FIGS. 2 and 3, and in the presently preferred embodiment comprises an hydraulic cylinder 128. The ram portion of the hydraulic cylinder is attached to one end of camshaft 50 by means of camshaft grasping chuck 124. Chuck 124 is indirectly attached to camshaft 50 by being securely attached to bearing 120 by bearing securement ring 126. Bearing 120 is securely attached to camshaft 50 by means of bearing positioning C-ring 122. The C-ring 122 holds the bearing 102 against the splined ridges 118 in camshaft 50. Hydraulic cylinder 128 is pivotally attached by pin 130 to a base 132, which may be an extension of block 38 or may comprise a secure part of the machine in which engine 10 has been positioned. Since internal combustion engines are presently resiliently attached to automobiles by mounts which absorb vibrations, it is preferred that the hydraulic cylinder be mounted to block 38 or an extension thereof. It is recognized that in contemporary engines, placement of the hydraulic cylinder as shown in FIG. 2, may interfere with the operation of a water pump (not shown in the Drawings) if the engine is water cooled. In such a situation, the mechanism for axially shifting the camshaft may be positioned on the rear of the engine, or in such other location as to prevent interference with the operation of other parts of the engine. In any event, as hydraulic cylinder 128 is activated, chuck 124 causes camshaft 50 to move axially without interference with its rotational movement. The camshaft gear 102, while being held in position by retaining fingers 104, rotates freely due to retaining finger bearing 108, positioned at the point of contact with gear 102, riding or following in retaining finger bearing path 106. The source of pressurized fluid for activating the hydraulic cylinder has not been shown in the drawings and is preferred to be done in the normal fashion. While it is preferred to use an hydraulic cylinder, a pneumatic, solenoid or manual device can also be utilized. In FIG. 3, camshaft 50 has been shifted to the second or higher speed position such that push rods 28 of cylinder 12*a* are now following the lift surfaces 73 of cam lobes 74 and 76. The intake port 18 and exhaust port 19 remain open for a longer timed interval, allowing a more efficient use of fuel at high engine speeds.

The multiple lift surfaces 71 and 73 of cam lobes 74 and 76 are shown more clearly in FIGS. 8–11. As push rods 28 follow the lobe between lift surfaces 71 and 73, as the camshaft is axially displaced, there are provided transition surfaces 140 which significantly reduce the lateral or side stress load on each push rod. It is preferred that the inclination or shape of these transition surfaces 140 be shaped in response to the lateral stress tolerances of the push rods being utilized in engine 10. This will ensure that as camshaft 50 moves from a first position to a second position push rods 28 will not bend due to the side stress load placed thereon. This could be accomplished by raising or lowering the angle of inclination of each transition surface.

Since camshaft 50 is slidably and rotatably disposed in block 38, side stress forces can be reduced by gradually displacing the camshaft over approximately $\frac{1}{4}$ rpm. Thus, push rods 28 do not abruptly move between surfaces 71 and 73, but move relatively smoothly, in a diagonal fashion, across the transition surfaces.

Figure 8:
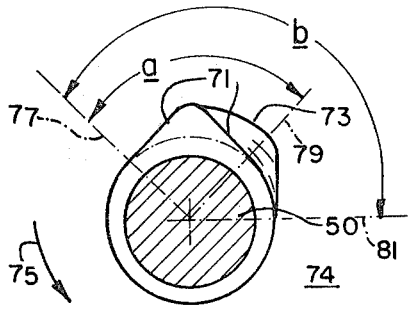
FIG. 8 is a section view along the line 8—8 of FIG. 4.
Figure 9:
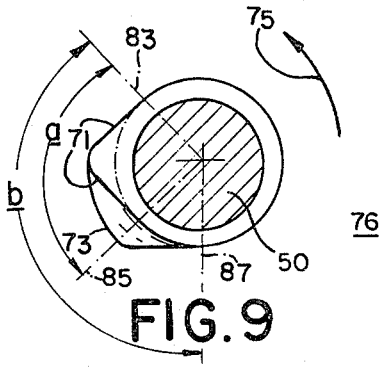
FIG. 9 is a section view along the line 9—9 of FIG. 4.
Figure 10:
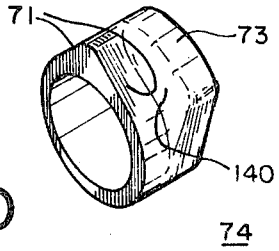
FIG. 10 is a perspective view of the cam lobe surfaces of FIG. 8.
Figure 11:
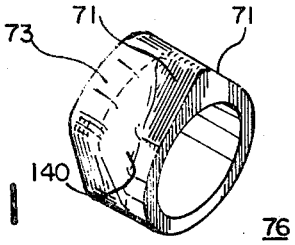
FIG. 11 is a perspective view of the cam lobe surfaces of FIG. 9.

In the sense of FIGS. 8 and 9, intake cam lobe 74 and exhaust cam lobe 76 each rotate counter clockwise as shown by arrows 75. In the presently preferred embodiment, each cam lobe has two lift surfaces, one each for high speed and low speed operation. Cam lobes having more than two multiple lift surfaces are also possible, the number of lift surfaces depending in part on the available axial length of the camshaft and the spacing between adjacent cylinders. In the presently preferred embodiment, both timed intervals of the intake cam lobe 74 begin at the same time, indicated by ray 77. Lift surface 71 extends to ray 79, providing the briefer timed interval, designated by angle a. Lift surface 73 extends to ray 81, providing the longer timed interval, designated by angle b. On the exhaust cam lobe 76 both timed intervals end at the same time, indicated by ray 83. The briefer timed interval provided by lift surface 71 extends from ray 85, designated angle a. The longer timed interval provided by lift surface 73 extends from ray 87, indicated by angle b. In both cam lobes 74 and 76, angles a are preferably in the range 95°–100°, and angles b are preferably in the range 125°–135°.

Figure 6:
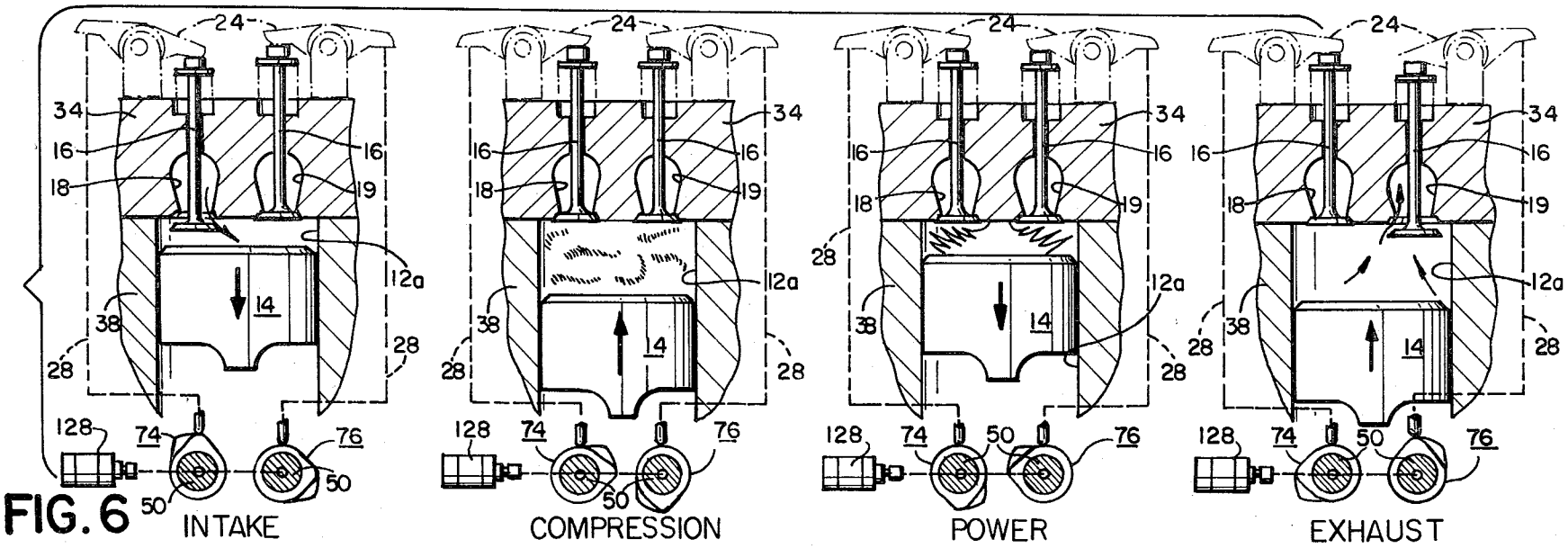
FIG. 6 is four schematic views of a single cylinder during each cycle of four cycle engine operation, showing the inter-relationship of poppet valves, the camshaft position and the hydraulic ram position in a low speed orientation.
Figure 7:
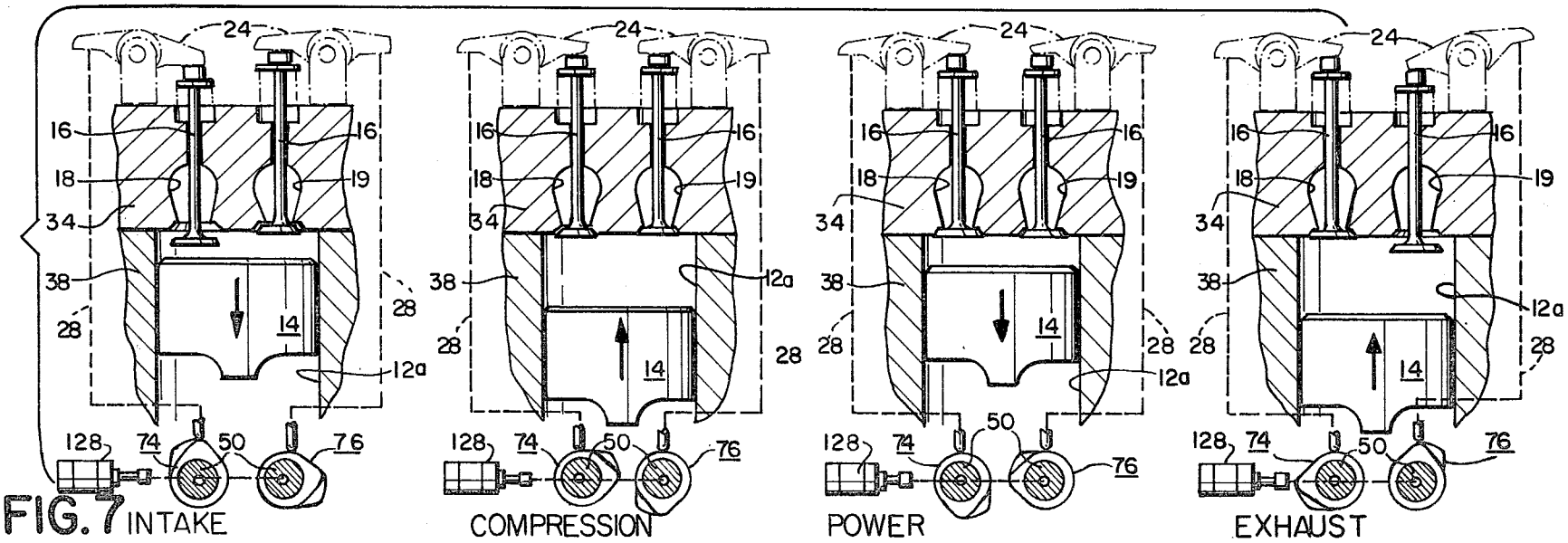
FIG. 7 is four schematic views of a single cylinder during each cycle of four cycle engine operation, showing the inter-relationship of the poppet valves, rocker arms and push rods to that cam lobe surface brought to bear after the hydraulic ram is extended in the high speed orientation.

FIGS. 6 and 7 show the invention during each stroke of a single cylinder during low speed (surfaces 71) and high speed (surfaces 73) conditions, respectively. Referring first to the INTAKE schematic of FIG. 6, the intake lobe 74 is forcing the push rod 28 upward which opens the intake port 18 into the cylinder. A fuel-air mixture is drawn into the cylinder by the downward motion of the piston. As the piston moves towards the intake and exhaust ports, as shown in the COMPRESSION schematic of FIG. 6, the air-fuel mixture is compressed and neither push rod is lifted, thus ensuring the closed position of the intake and exhaust poppet valves. In the POWER schematic of FIG. 6, the spark plug has ignited the compressed air-fuel mixture and is forcing the piston away from the intake and exhaust ports. As during COMPRESSION, neither push rod is activated by the surface of the cam lobes, ensuring the closed position of the intake and exhaust poppet valves. In the EXHAUST schematic of FIG. 6, the piston is again moving towards the intake and exhaust valves. The exhaust cam lobe 76 has forced the push rod 28 away from the camshaft, forcing the exhaust poppet valve to open. The rising action of the piston forces the gases contained in the cylinder out through the open exhaust valve.

In FIG. 7, the hydraulic cylinder has been activated causing the camshaft to shift axially, which brings lift surfaces 73 to bear against the push rods. It is assumed that engine 10 is in a high speed condition. The INTAKE schematic shows the intake lobe forcing push rod 28 upwardly, opening intake port 18. Since the exhaust valve now provides longer lift, an overlap has occurred, and the exhaust valve has not yet quite closed. This condition can be safely accomodated for approximately 2°–10° of camshaft rotation. In the COMPRESSION and POWER schematics, both intake and exhaust valves are shown as closed. However, due to the longer lift surfaces, the intake valve does not close until after the piston reaches bottom dead center. It is preferred that the intake valve remain open for approximately 25°–35° of rotation of the camshaft beyond the bottom dead center of the piston movement. During the POWER stroke, the exhaust valve will open prior to the piston reaching bottom dead center. It is preferred that this condition exist for approximately 25°–35° of rotation of the camshaft prior to the piston reaching bottom dead center. Unlike during the INTAKE stroke, the opening of the intake and exhaust valves do not overlap during the exhaust stroke. Thus, the exhaust and intake poppet valves are maintained in an open position for a longer time period during the strokes of engine 10. Internal combustion engines require the opening of the poppet valves to be responsive to the rising action of the pistons in the cylinders. Thus, the instant invention will save fuel, and money, due to the adaptability of valve or port operation to low speed or high speed conditions.

Figure 12:
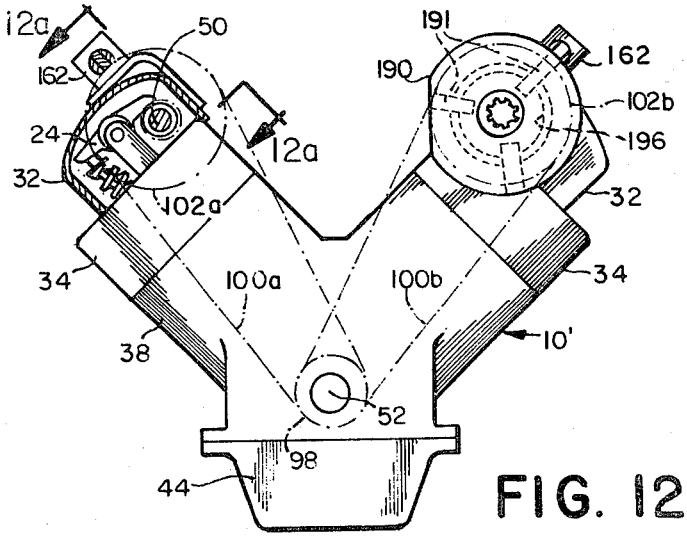
FIG. 12 is a front elevational view, partly cut away, of an alternative embodiment of the present invention.
Figure 12A:
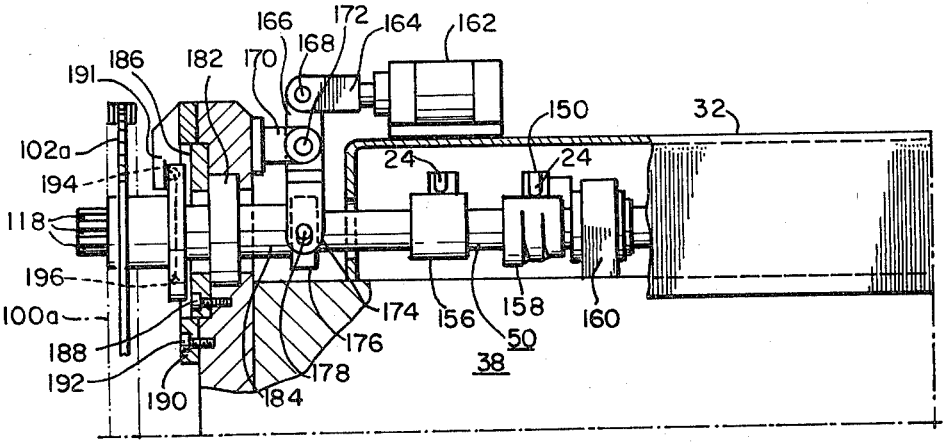
FIG. 12*a* is a section view along the line 12*a*—12*a* of FIG. 12; and, FIG. 13 is a flow chart showing the activation of the means for shifting the camshaft in response to engine conditions.

An alternative embodiment for axially displacing the camshaft is illustrated in FIGS. 12 and 12*a* which show an engine 10' with overhead camshafts. A lever arm 166 is pivotally attached to the block 38 on bracket 170. One end of the lever arm is attached to the camshaft and the other end of the lever arm is attached to an hydraulic cylinder, or other means capable of pivoting the arm. Hydraulic cylinder 162 is pivotally attached to one end of lever 166 by attaching the lever arm grasping chuck 164 to the lever arm by pin 168. The other end 174 of lever arm 166 is securely but pivotally attached to bearing 176 by pin 178. Bearing 176 is in turn securely attached to camshaft 50. Thus, upon activating cylinder 162 the lower arm 166 will pivot about pin 172 forcing bearing 176 and camshaft 50 to move in an axial direction.

The camshaft is again rotatably and slidably disposed with a sleeve 184 which is securely attached to camshaft bearing 182. Bearing 182 is in turn securely attached to block 38 by means of camshaft bearing securement ring 186 which is secured to block 38 by bolt 188. Similar to FIGS. 2 and 3, the end of camshaft 50 contains splined ridges 118 which pass through corresponding grooves in camshaft gear 100*a*. Similarly, camshaft gear 100*a* is held in position by camshaft gear retaining fingers 191 which are disposed at 120° intervals about finger base 190. Base 190 is securely attached to block 38 by bolt 192. To reduce friction between retaining finger 191 and gear 100*a*, retaining finger bearing 194 has been positioned on the end of retaining finger 191 and follows in retaining finger bearing path 196 disposed on gear 100*a*. Thus, it can been seen that by shifting camshaft 50 from a first to a second position, bringing different lift surfaces to bear in each position, fuel is efficiently used while engine 10 is operating in low and high speed conditions.

In the overhead camshaft arrangement push rods 28 have been eliminated and rocker arms 24 rest directly on the lobes of camshaft 50. The circumference of crankshaft gear 98 is half that of the circumference of camshaft gears 102*a* or 102*b*. As in the conventional arrangement, the camshaft gears are activated by chains 100*a* and 100*b* respectively. Hydraulic cylinder 162 is securely attached to valve cover 32. Camshaft 50 is slidably and rotatably disposed beneath the rocker arms 150, which have been adapted at one end to follow the cam surfaces, by the camshaft positioning brackets 160. Since there are now two camshafts which activate the rocker arms of engine 10, there are only two cam lobes associated with cylinder 12*a*. The rocker arms 150 are activated by cam lobes 156 and 158 which are similar to cam lobes 74 and 76, respectively.

As there are fewer cam lobes per camshaft in this embodiment, each cam lobe can be wider, and more than two lift surfaces can be accomodated. Each of the three positions shown may correspond to separate valve timing, for example timing most efficient for idling, low speed and high speed engine conditions. It is preferred that the first surface provide idling lift comprising approximately 90°–100° of rotation of the camshaft, that the second surface provide low speed lift comprising approximately 100°–110° of rotation of the camshaft and that the third surface provide high speed lift comprising approximately 115°–125° of rotation of the camshaft. In this third position, the opening of the intake port will overlap somewhat with the closing of the exhaust port.

It is preferred that if the instant invention is used in an automobile, for example, that the means for axially displacing the camshaft be responsive to the transmission operation, speedometer, manifold pressure and/or other engine condition indicators or parameters, such that when the engine reaches a preselected speed and/or load condition and/or gear range, for example, the displacing means is activated and the camshaft is shifted, allowing fuel to be more efficiently used.

Figure 13:
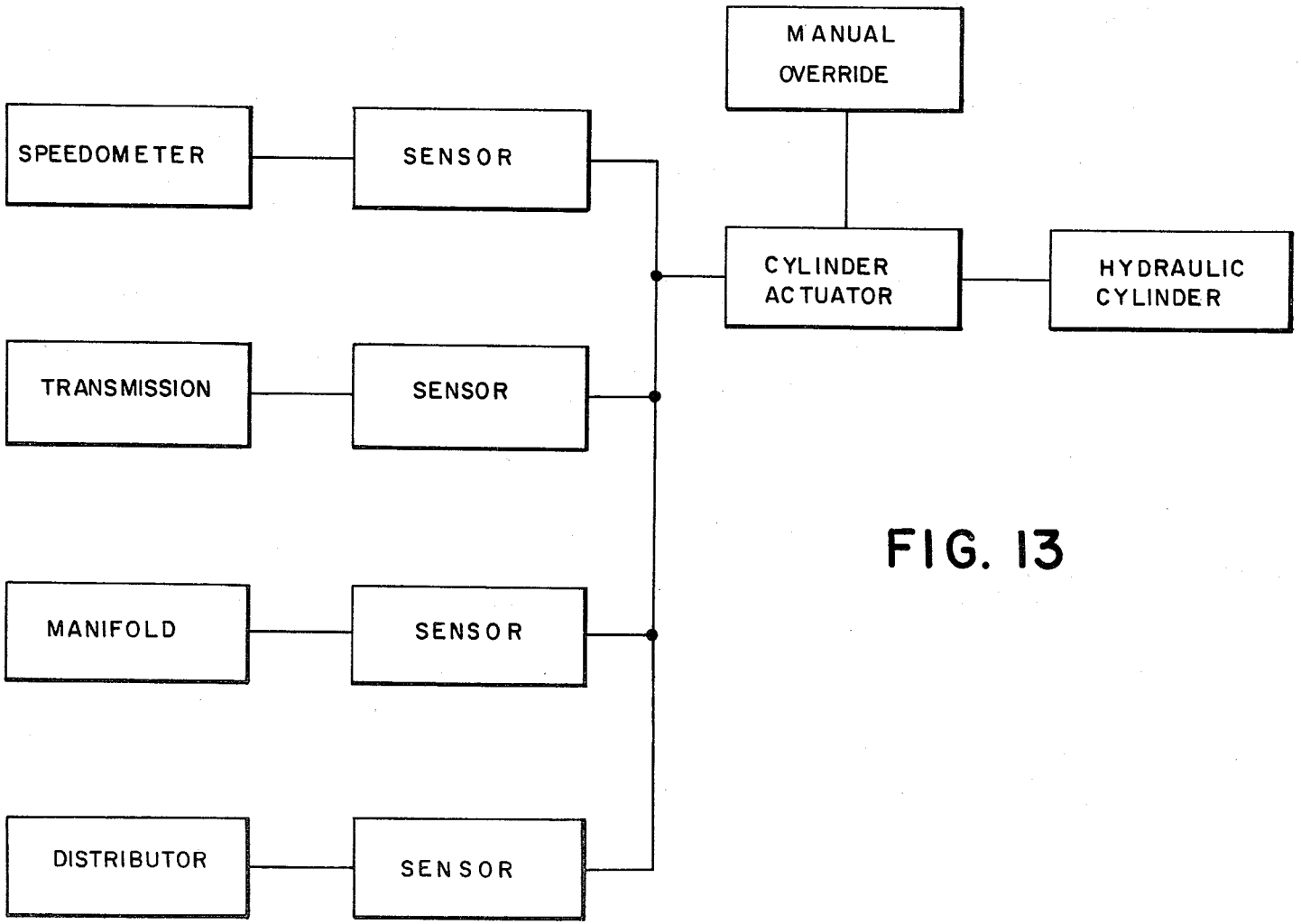

FIG. 13 is a schematic diagram showing this operation. A sensor is connected to each of the speedometer, manifold, transmission, and distributor to determine when the automobile reaches predetermined parameters. The speedometer sensor detects vehicle speed. The sensor connected to the manifold detects engine vacuum, which reflects engine loading. The transmission sensor may detect gear ranges, which in an automatic transmission are normally Low, Second and High. Some automatic transmissions are now equipped with a fourth range, Overdrive. Finally, the distributor sensor, a tachometer, detects engine speed. A cylinder actuator includes a controller, being electromechanical, electronic or both. Based upon predetermined parameters, the actuator will command the cylinder accordingly. These parameters will vary for each combination of vehicle and drive train arrangements, and the controller should also include means for adjusting the predetermined parameters. For example, irrespective of engine speed, a camshaft shift bringing the high speed lift surfaces to bear might be inhibited except in High or Overdrive. As another example, a decrease in manifold pressure, irrespective of speed (e.g. maintaining vehicle speed going up a steep incline), may cause a shift to the low speed surfaces. In a car with a manual transmission engine speed may be more significant than vehicle speed. In view of the many possibilities such automatic control is preferred. However, a manual override is also provided so that the camshaft may be axially shifted at any time, perhaps for testing.

It is also preferred that when the camshaft shifts from a high speed setting to a low speed setting, it does so at a point of rotation which allows the least amount of total opening of all intake ports being effected. When the camshaft is shifting, inevitably certain of the intake ports will be open when their pistons have passed bottom dead center. It is therefore preferred that the total amount of opening of all of the intake ports be kept at a minimum, keeping fuel loss at a minimum. An indentation or small raised area could be located on the surface of the camshaft which is sensed by a device which prevents the axial displacement of the camshaft. Thus, if the engine is going from a high speed to a low speed condition, such that the hydraulic cylinder is being activated, such activation will not take place until the marking on the camshaft passes the sensor, ensuring a predetermined camshaft rotational position at the time axial displacement begins.

The present invention may be embodied in other specific forms without departing from the spirit or essential attributes thereof, and, accordingly, reference should be made to the appended Claims, rather than the foregoing Specification, as indicating the scope of the invention.

I claim:

1. An internal combustion engine, having at least one cylinder, comprising:

an axially displaceable cam shaft;

at least two cams fixed for rotation together with the cam shaft;

the at least one cylinder having an intake and an exhaust valve, each valve being operable by a cam-activated push rod;

the intake valve being operable by a first multiple lobe cam having at least two push rod activating lobes, one of the lobes having a first eccentric circumferential surface relative to the cam shaft axis for periodically opening and closing the intake valve over a first timing range, and the other of the at least two lobes having a second eccentric circumferential surface relative to the camshaft axis for periodically opening and closing the intake valve over a second timing range, the cam further having a transition surface on which the push rod can easily slide between adjacent lobes;

the exhaust valve being operable by a second multiple lobe cam having at least two push rod activating lobes, one of the lobes having a third eccentric circumferential surface relative to the cam shaft axis for periodically opening and closing the exhaust valve over a third timing range, and the other of the at least two lobes having a fourth eccentric circumferential surface relative to the camshaft axis for periodically opening and closing the exhaust valve over a fourth timing range, the cam further having a transition surface on which the push rod can easily slide between adjacent lobes; and, the respective lobes of the multiple lobe cams being selectively positionable to engage and activate the push rods through axial displacement of the cam shaft during operation of the engine, whereby the timing ranges of the intake and exhaust valves may be selected, without interfering with operation of the engine, to improve efficiency and gas mileage at different engine speed ranges.

2. The internal combustion engine of claim 1, further comprising means for axially displacing the camshaft.

3. The internal combustion engine of claim 2, wherein the means for axially displacing the camshaft comprises a lever arm pivotally mounted on the engine, one end of which is attached to the cam shaft and the other end of which is attached to an hydraulic cylinder.

4. The internal combustion engine of claim 2, further comprising means for automatically activating the hydraulic cylinder in response to engine speed and other operating parameters.

5. The internal combustion engine of claim 3, further comprising means for manually activating the hydraulic cylinder.

6. The internal combustion engine of claim 1, wherein the first and third timing ranges correspond to low speed operation, the first and third eccentric surfaces being shaped accordingly, and the second and fourth timing ranges correspond to high speed operation, the second and fourth eccentric surfaces being shaped accordingly.

7. The internal combustion engine of claim 6, wherein each cam comprises a third eccentric circumferential surface, providing timing ranges for idle speed operation.

8. The internal combustion engine of claim 1, wherein each cam comprises three eccentric circumferential surfaces, the surfaces being shaped to provide maximum efficiency at idle speed, low speed and high speed operation.

9. The internal combustion engine of claim 1, wherein the radius of each eccentric circumferential surface, throughout the circumference, is sufficiently large to maintain contact between the cams and the push rods.

* * * * *